United States Patent [19]

Furuya

[11] Patent Number: 4,856,487

[45] Date of Patent: Aug. 15, 1989

[54] GAS FLOW RATE CONTROL SYSTEM FOR INTERNAL COMBUSTION ENGINE

[75] Inventor: Katsuji Furuya, Tokyo, Japan

[73] Assignee: Kabushiki Kaisha Tsuchiya Seisakusho, Tokyo, Japan

[21] Appl. No.: 945,591

[22] Filed: Dec. 23, 1986

[30] Foreign Application Priority Data

Dec. 24, 1985 [JP] Japan ..... 60-289457
Feb. 28, 1986 [JP] Japan ..... 61-27348[U]
Feb. 28, 1986 [JP] Japan ..... 61-27349[U]

[51] Int. Cl.[4] ..... F02M 25/06
[52] U.S. Cl. ..... 123/574
[58] Field of Search ..... 123/574, 572

[56] References Cited

U.S. PATENT DOCUMENTS 2,362,558 11/1944 Janzich ..... 123/574
3,175,546 3/1965 Roper ..... 123/572
4,686,952 8/1987 Zeigler et al. ..... 123/574

FOREIGN PATENT DOCUMENTS 0027016 3/1981 Japan ..... 123/572

*Primary Examiner*—Willis R. Wolfe, Jr.
*Assistant Examiner*—M. Macy
*Attorney, Agent, or Firm*—Foley & Lardner, Schwartz, Jeffery, Schwaab, Mack, Blumenthal & Evans

[57] ABSTRACT

A gas flow rate control system for controlling the flow rate of blow-by gas to be recirculated back to the combustion chamber in an internal combustion engine. The gas flow rate control system comprises a PCV valve disposed in a gas flow passage through which blow-by gas flows in the direction of the engine combustion chamber. A bypass passage is formed in such a manner as to connect the upstream side and the downstream side of the flow control section of the control valve in the gas flow passage. A bypass control valve is disposed in the bypass passage to control the flow of blow-by gas through the bypass passage in response to an engine operating parameter such as intake manifold vacuum, thereby compensating the control characteristics of the PCV valve in order to achieve precise control of the amount of recirculated blow-by gas in accordance with engine operating conditions.

14 Claims, 8 Drawing Sheets

GAS FLOW RATE CONTROL SYSTEM FOR INTERNAL COMBUSTION ENGINE

BACKGROUND OF THE INVENTION

1. Field of the Invention

The present invention relates generally to a gas flow rate control system used for an internal combustion engine, and more particularly to the gas flow rate control system for controlling recirculation of gas discharged from the engine back to the same engine in accordance with engine operating conditions.

2. Description of the Prior Art

Most automotive vehicles are equipped with a blow-by gas recirculation system by which so-called blow-by gas leaking from engine combustion chamber to a crankcase is recirculated back to the combustion chamber in order to prevent air pollution and engine performance deterioration. This is called a positive crankcase ventilation (PCV) system and includes a PCV valve adapted to control the flow rate of blow-by gas recirculated back to the engine combustion chamber thereby to prevent fuel concentration of air-fuel mixture to be supplied to the engine. Thus, the PCV valve forms a part of a gas flow control system for blow-by gas.

Recently it has been eagerly desired to improve the function of the PCV valve from view points of strengthening emission control, facilitating fuel consumption control and improving idling operation stability. In order to achieve this goal, it is required that the gas flow rate of the PCV valve correspond to the production amount of blow-by gas to be discharged to a crankcase. That is to say, in case the gas flow rate of the PCV valve is too small relative to the production amount of blow-by gas, the whole amount of blow-by gas cannot be sucked through the PCV valve into the engine combustion chamber and accordingly a part of the blow-by gas is emitted into the atmosphere or enters an air cleaner and a carburetor thereby contaminating them. On the contrary, in case the gas flow rate of the PCV valve is too large relative to the production amount of blow-by gas, a relatively large amount of fresh air is taken into the crankcase through a filler cap or the air cleaner. This unavoidably lowers the rate of fresh intake air inducted through an intake air passage relative to the amount of blow-by gas flowing through the PCV valve particularly under low load engine operating conditions.

In this regard, the conventional PCV valve is so configurated to control the flow rate of the gas flowing through the gas flow passage only in response to engine intake vacuum, and therefore cannot control the gas flow rate in accordance with the production amount of blow-by gas, i.e., in accordance with engine operating conditions, thus making impossible precise control of blow-by gas to be recirculated back to engine combustion chamber.

SUMMARY OF THE INVENTION

A gas flow rate control system according to the present invention is used for an internal combustion engine provided with an intake air passage through which intake air forming an air-fuel mixture to be inducted into the engine combustion chamber flows. The gas flow rate control system comprises a control valve operatively disposed in a gas flow passage through which gas discharged from the engine combustion chamber is supplied back to the engine combustion chamber. The gas flow passage is provided independent of the intake air passage. The control valve is adapted to control the flow rate of the gas flowing through the gas flow passage in accordance with scheduled control characteristics, for example, corresponding to intake vacuum developed in the engine. Additionally, a compensating device is provided to compensate or change the control characteristics in response to an engine operating parameter.

Accordingly by virtue of the compensating device, the control characteristics of the control valve can be changed in response to the engine operating parameter, thereby making possible precise control of the gas recirculated back to the combustion chamber in accordance with engine operating conditions or with the production amount of the gas in the engine.

BRIEF DESCRIPTION OF THE DRAWINGS

The features and advantages of the gas flow rate control system according to the present invention will be more clearly appreciated from the following description taken in conjunction with the accompanying drawings in which like reference numerals designate corresponding elements and parts, and which.

DETAILED DESCRIPTION OF THE INVENTION

Figure 1A:
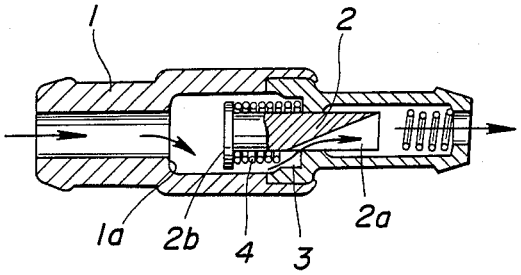
FIG. 1A (PRIOR ART)
FIGS. 1A and 1B are longitudinal cross-sectional views of a conventional control valve or PCV valve forming part of a gas flow rate control system for blow-by gas in an internal combustion engine, showing two operation modes, respectively.
Figure 1B:
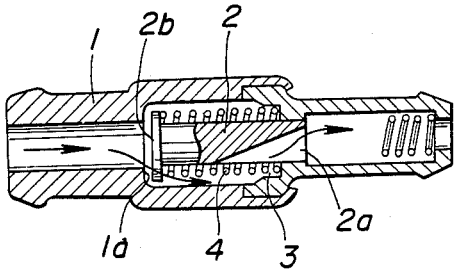
FIG. 1B (PRIOR ART)

To facilitate understanding of the present invention, a brief reference will be made to a conventional PCV valve through which blow-by gas is controllably recirculated back to the combustion chamber of an internal combustion engine, depicted in FIGS. 1A and 1B. The PCV valve forms part of a gas flow rate control system for blow-by gas to be recirculated back to the engine combustion chamber. Referring to FIGS. 1A and 1B, the PCV valve includes a casing 1 formed with a through-hole forming part of a gas flow passage through which blow-by gas flows from a crankcase to an intake manifold. A valve member 2 is movably disposed in the through-hole of the casing 1 to control the flow rate of the blow-by gas. The valve member 2 is formed with an axially inclined slot 2*a* constituting a flow rate control section 3, with inner wall surface of the casing through-hole. The valve member 2 is normally biased by a valve spring 4 in such a direction that a flange section 2*b* thereof contacts with a valve seat 1*a* formed inside the casing 1, so that the PCV valve is put into its closed state when the engine is being stopped in which no intake manifold vacuum is built. Thus, the PCV valve is adapted to cause the gas flow passage to open or close in accordance with the relationship between the biasing force of the valve spring 4 and the magnitude of intake manifold vacuum. In other words, when the force due to the intake manifold vacuum is larger than the biasing force of the valve spring 4, the PCV valve is put into its open state; and when the intake manifold vacuum further increases, the gas flow passage at the flow rate control section 3 is narrowed, thus automatically controlling the flow rate of gas passing through the PCV valve in response to the magnitude of the intake manifold vacuum. More specifically during idling, a smaller amount of blow-by gas is produced, higher or stronger intake vacuum is developed and therefore the valve member 2 is sucked and moved against the biasing force of the valve spring 4 as shown in FIG. 1A thereby to narrow the gas flow passage at the flow rate control section 3. This decreases the flow rate of the gas to be recirculated back to the engine combustion chamber. During acceleration or high load engine operation where a larger amount of blow-by gas is produced, lower or weaker intake manifold vacuum is developed and therefore the valve member 2 is pushed back under the biasing force of the valve spring 4 as shown in FIG. 1B thereby to widen the gas flow passage at the flow rate control section 3. This increases the flow rate of the gas to be recirculated back to the engine combustion chamber.

It will be understood that the above-discussed PCV valve is usable in a variety of blow-by gas recirculation (PCV) systems. For example, the PCV valve is employed in so-called open type blow-by gas recirculation system in which blow-by gas in a crankcase is mixed with fresh air taken in through an oil filler cap open to the atmosphere and sucked into an intake manifold to be burned in the engine combustion chamber. The PCV valve is installed at the outlet section of a manifold suction tube connecting the crankcase and the intake manifold. This open type blow-by gas recirculation system is advantageous because of simple construction and causing less trouble. However, during high load engine operation where intake manifold vacuum is weakened though a larger amount of blow-by gas is generated, all the blow-by gas cannot be sucked into the intake manifold thereby to emit harmful gas containing a large amount of hydrocarbons through the oil filler cap open to the atmosphere.

Further, the PCV valve is employed in closed type blow-by gas recirculation systems in which the crankcase and the intake manifold are connected by a manifold suction tube provided with the PCV valve while connecting the inside of a top cover chamber and an air cleaner by a pipe. In this closed type blow-by gas recirculation system, blow-by gas in the crankcase is sucked together with fresh air from the air cleaner to the intake manifold to be again burned in engine combustion chamber, in which metering of blow-by gas to be sucked into the intake manifold is made by the PCV valve. More specifically, blow-by gas is sucked into the intake manifold to be again burned during low load engine operation where higher or stronger intake vacuum is developed, whereas the blow-by gas is sucked through the top cover chamber and the air cleaner to a carburetor to be again burned, for example, during full load engine operation where lower or weaker intake manifold vacuum is developed. The closed blow-by gas recirculation system is advantageous in preventing harmful gas emission; however, the PCV valve tends to be readily clogged with oil mist and impurities contained in the blow-by gas.

As discussed above, the PCV valve is disposed between the crankcase and the intake manifold and so configured that the valve member thereof moves to change the cross-sectional area of the gas flow passage thereby to control the flow rate of the gas to be sucked into the intake manifold or engine combustion chamber.

However, recently it has been eagerly desired to improve the function of the PCV valve from view points of strengthening emission control, facilitating fuel consumption control, and improving idling operation stability, in which the gas flow rate of the PCV valve is required to correspond to the amount of blow-by gas discharged into the crankcase. That is to say, if the gas flow rate of the PCV valve is too small relative to the amount of blow-by gas discharged into the crankcase, all the blow-by gas cannot be sufficiently sucked through the PCV valve to the engine combustion chamber and therefore is emitted into the atmosphere or enters an air cleaner and a carburetor thereby to contaminate them. On the contrary, if the gas flow rate of the PCV valve is too large relative to the blow-by gas amount in the crankcase, a relatively large amount of fresh air is taken into the crankcase through the oil filler cap or the air cleaner. This unavoidably lowers the rate of fresh intake air inducted into the engine intake system relative to the gas flow rate of the PCV valve, particularly under an engine operating condition of low engine load in which air-fuel ratio control is carried out with a relatively small amount of intake air upon using a carburetor, an electronically controlled system combined with a carburetor, or an electronically controlled gasoline injection system. Accordingly, it is difficult to suitably control the air-fuel ratio particularly during idling in order to obtain engine running stability.

Additionally, with the conventional PCV valve as shown in FIGS. 1A and 1B, the flow rate of the gas passing through the PCV valve is minimized during high speed and low load engine operating condition even though a large amount of blow-by gas is discharged into the crankcase during such an engine operating condition. This makes insufficient crankcase ventilation in which blow-by gas is emitted to the atmosphere or enters the air cleaner and the carburetor thereby to contaminate them.

Furthermore, the conventional PCV valve is arranged to control the gas flow rate thereof in accordance with the relationship between the biasing force of the valve spring and the magnitude of intake manifold vacuum, so that precise control of the gas flow rate is difficult thereby causing the states of the gas flow rate being too large or too small relative to the blow-by gas amount discharged into the crankcase.

Thus, the gas flow rate of the PCV valve is required to be precisely controlled in accordance with the amount of blow-by gas discharged from the engine combustion chambers into the crankcase, i.e., in accordance with engine operating conditions since the discharged amount of blow-by gas changes corresponding to engine operating conditions.

Figure 2:
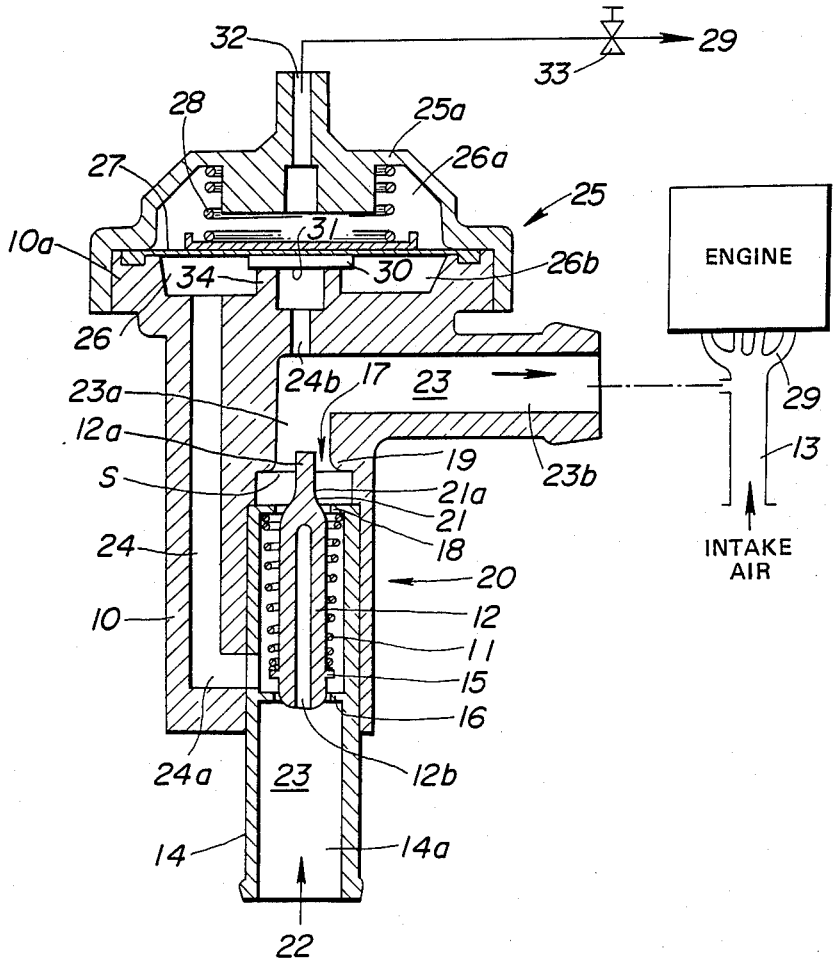
FIG. 2 is a vertical cross-sectional view of a first embodiment of a gas flow rate control system according to the present invention, for blow-by gas in an internal combustion engine.

In view of the above description of the gas flow rate control system including the conventional PCV valve, reference is now made to FIG. 2 wherein a first embodiment of a gas flow rate control system is illustrated. In this embodiment, the gas flow rate control system is for controlling the flow rate of gas containing blow-by gas to be sucked from a crankcase (not shown but identified at 22) to an intake manifold 29 in an internal combustion engine of an automotive vehicle. The gas flow rate control system comprises a casing 10 which is formed with a vertical cylindrical opening (no numeral) in which a control (PCV) valve or valve assembly 20 is securely disposed.

The control valve 20 includes a cylindrical valve housing 14 fitted in the casing vertical cylindrical opening. An elongate valve member 12 is movably disposed inside and axially aligned with the valve housing 14. A coiled compression spring 11 is located around the valve member 12 and disposed between an annular upper spring seat 18 formed in the upper end section of the valve housing 14 and an annular lower spring seat 15 formed in the lower end section of the valve member 12, so that the valve member 12 is biased downward in the drawing. The lower end section of the valve member 12 is contractable with an annular valve seat 16 formed at the inner peripheral surface of the valve housing 14 at the intermediate part, so that the valve member 12 is prevented from its further downward movement. The upper end section of the valve member 12 is projectable out of the valve housing 14 through an opening defined by the annular spring seat 18 of the valve housing 14. A tapered portion 21 is formed in the upper end section of the valve member 12 and constitutes a flow rate control section 17, in combination with a radially inwardly projected annular projection 19 defining part of the short vertical portion 23*a* of a gas flow passage 23 through which the crankcase 22 is fluidly connected with the intake manifold 29, so that the gas containing blow-by gas flows through the passage 23. It will be understood that the gas flow passage 23 is separate and independent from an intake air passage 13 through which intake air forming air-fuel mixture to be combusted in the engine combustion chamber flows. An upwardly extending straight portion 12*a* is formed in the upper end section of the valve member 12 in such a manner as to be contiguous to the smaller diameter end 21*a* of the tapered portion 21. The straight portion 12*a* projects over the annular projection 19 even when the lower end section of the valve member 12 is seated on the valve seat 16 as shown in FIG. 2, so that the valve member 12 is guided upwardly along the gas flow passage vertical portion 23*a* through a spaced defined by the annular projection 19. Accordingly, the straight portion 12*a* and the tapered portion 21 of the valve member 12 are generally coaxial with the annular projection 19 and the gas flow passage vertical portion 23*a*. The valve member 12 is axially formed with an elongate hole 12*b* whose upper end is closed and lower end is opened through the lower end section of the valve member 12 to communicate with the control valve casing inside space 14*a*. The elongate hole 12*b* is formed coaxial with the valve member 12.

It will be understood that a gas flow space S formed between the valve member tapered portion 21 and the annular projection 19 is decreased or narrowed as the valve member tapered portion 21 approaches the annular projection 19. In this embodiment, the gas flow passage vertical portion 23*a* is axially aligned with the valve housing 14 of the control valve 20. The gas flow passage 23 further includes a horizontal portion 23*b* which intersects at right angles with the vertical portion 23*a* and located on the downstream side of the vertical portion 23*a*. The horizontal portion 23*b* is communicated with the intake manifold. It will be appreciated that the vertical portion 23*a* of the gas flow passage 23 is brought into communication with an inside space 14*a* of the valve housing 14 located on the upstream side of the valve seat 16 when the valve member 12 moves upward to separate from the valve seat 16. The inside space 14*a* forms part of the gas flow passage 23 and is communicated with the crankcase 22.

A bypass passage 24 is formed in the casing 10 and has an inlet portion 24*a* and an outlet portion 24*b*. The inlet portion 24*a* is communicated with the inside space of the valve housing 14 on the downstream side of the valve seat 16. The outlet portion 24*b* is communicated with the gas flow passage 23 donwstream of the flow rate control section 17. In this embodiment, the inlet portion 24*a* is perpendicular to the axis of the valve housing 14. The outlet portion 24*b* is coaxial with the gas flow passage vertical portion 23*a*. Accordingly, a part of the gas supplied to the gas flow passage upstream of the control valve 20 can flow through the bypass passage 24 and be directly supplied to the gas flow passage 23 downstream of the control valve 20 without passing through the control valve 20 when the lower end section of the valve member 12 separates from the valve seat 16.

A pneumatically operated diaphragm actuator 25 is provided at the top section of the casing 10 and includes a generally dome-shaped cover section 25*a* whose peripheral portion is sealingly secured to an annular portion 10*a* in the top section of the casing 10, so that a gas-tight sealed space 26 is formed between the casing 10 and the cover section 25*a*. Additionally, a diaphragm member 27 is provided in such a manner that its peripheral portion is securely put between the casing 10 and the diaphragm actuator casing section 25*a*. The diaphragm member 27 divides an inside space 26 of the actuator 25 into a vacuum chamber 26*a* and a gas chamber 26*b*. The vacuum chamber 26*a* is communicated through a vacuum inlet port 32 with the intake manifold 29 so as to be supplied with intake manifold vacuum. A space defined inside the casing annular portion 10*a* serves as a major part of the gas chamber 26*b*. The gas chamber 26*b* is communicated with the bypass passage 24 in such a manner as to form part of the bypass passage 24, so that the gas chamber 26*b* is supplied with the gas flowing through the bypass passage 24. The diaphragm member 27 is securely provided at its central portion with a flat valve member 30 whose contacting surface is contactable with a cylindrical valve seat 34. The cylindrical valve seat 34 projects upwardly from the bottom surface of the space defined inside the annular portion 10*a*. The level of the top end of the cylindrical valve seat 34 is lower than that of the casing annular portion 10*a*. The cylindrical valve seat 34 is coaxial with the bypass passage outlet portion 24*b* so that a space inside the cylindrical valve seat 34 is communicated through the outlet portion 24*b* with the gas flow passage 23. Accordingly, the bypass passage outlet portion 24*b* is brought into communication with the bypass passage inlet portion 24*a* when the valve member 30 separates from the cylindrical valve seat 34. A compression spring 28 is disposed within the vacuum chamber 26*a* to bias the diaphragm member 27 in a direction (or downwardly in the drawing) to cause the contacting surface 31 of the valve member 30 to contact the cylindrical valve seat 34 to block fluid flow through the bypass passage 24. The spring 28 is so selected that the diaphragm member 27 is moved in a direction (or upwardly in the drawing) to cause the contacting surface 31 of the valve member 30 to separate from the valve seat 34 when intake manifold vacuum higher or stronger than a predetermined level is supplied to the vacuum chamber 26*a*.

The reference numeral 33 designates a known vacuum control valve which may be disposed in a vacuum passage connecting the vacuum inlet port 32 of the vacuum chamber 26*a* and the intake manifold 29 and arranged to control the vacuum to be supplied to the vacuum chamber 26*a* in accordance with engine operating parameters or conditions. The vacuum control valve 33 may be of the mechanically or electrically operated type and form part of a mechanically or electrically operated vacuum control system though not shown.

The manner of operation of the thus configured gas flow rate control system will be discussed hereinafter.

When intake vacuum acts on the valve member 12 of the control valve 20, the valve member 12 is moved upwardly as viewed in the drawing so that its lower end section separates from the valve seat 16 against the bias of the spring 11 to form a clearance therebetween. The gas supplied from the crankcase 22 to the valve housing inside space 14*a* flows through the clearance into the valve housing inside space defined between the valve seat 16 and the annular spring seat 18 of the valve housing 12, and thereafter discharged out of the valve housing 14 through the opening defined inside the spring seat 18. Then, the gas flows upwardly as viewed in the drawing through the space S of the flow rate control section 17 and then flows through the vertical and horizontal portions 23*a*, 23*b* of the gas flow passage 23 to be supplied to the intake manifold 29.

Under an engine operating condition where a relatively high or strong vacuum is prevailing in the intake manifold 29, the valve member 12 of the control valve 20 moves largely upwardly as viewed in the drawing so that the tapered portion 21 approaches the surface of the annular projection 19 thereby narrowing the space S therebetween. This decreases the flow rate of the gas flowing through the gas flow passage 23 and therefore reduces the amount of blow-by gas to be supplied to engine combustion chamber.

Under an engine operating condition where a relatively low or weak intake manifold is prevailing in the intake manifold 29, the valve member 12 of the control valve moves slightly upwardly as viewed in the drawing so that the tapered portion 21 of the valve member 12 moves slightly toward the annular projection 19 so that the space S between the valve member tapered portion 21 and the annular projection 19 is maintained relatively large. This increases the flow rate of the gas flowing through the gas flow passage 23 and therefore increases the amount of blow-by gas to be supplied to the engine combustion chamber.

When the intake manifold vacuum supplied to the vacuum chamber 26*a* of the diaphragm actuator 25 exceeds the predetermined level throughout all engine operating conditions, the diaphragm member 27 of the diaphragm actuator 25 moves upwardly as viewed in the drawing against the bias of the spring 20 thereby to cause the contacting surface 31 of the valve member 30 to separate from the cylindrical valve seat 34. This allows the bypass passage inlet and outlet portions 24*a*, 24*b* to communicate with each other. Consequently, a part of the gas supplied to the valve housing inside space downstream of the valve seat 16 flows through the bypass passage 24 and supplied to the gas flow passage 23 downstream of the flow rate control section 17. This bypassed gas is then mixed with the gas passing through the space S of the flow rate control section 17, thereby increasing the flow rate of the gas flowing through the gas flow passage 23. As a result, the amount of the gas to be supplied to the engine combustion chamber is increased under engine operating conditions where an increased flow rate of the gas is required corresponding to the amount of blow-by gas discharged from the engine combustion chamber into the crankcase 22.

Such gas flow rate increasing action of the gas flow control system is particularly effective under a high speed and low load engine operating condition where a high intake manifold vacuum exceeding the predetermined level is built in the intake manifold 29. This is because, during this engine operating condition, a considerable amount of blow-by gas is discharged into the crankcase and therefore it is required to increase the flow rate of the gas to be fed through the gas flow passage 23 to the engine combustion chamber in order to absorb the whole amount of blow-by gas. Accordingly, the gas flow control system can prevent blow-by gas from being emitted to the atmosphere in the case of being used in combination with an open type blow-by gas recirculation system and from entering an air cleaner and a carburetor thereby to protect them from contamination. Thus, in this embodiment, the amount of blow-by gas to be supplied to the engine combustion chamber can effectively be controlled in response to intake manifold vacuum by the control valve (PCV valve) 20, thereby achieving a precise control of the amount of recirculated blow-by gas in accordance with engine operating conditions or with the amount of blow-by gas to be discharged from the combustion chamber into the crankcase 22. It will be understood that the location of the diaphragm actuator valve member 30 relative to the valve seat 34 may be delicately varied in accordance with the magnitude of intake vacuum supplied to the vacuum chamber **26*a*** thereby achieving precise control of the recirculated blow-by gas amount.

In addition, it will be understood that if the vacuum control valve 33 is used in the vacuum passage connecting the diaphragm actuator vacuum chamber **26*a* and the intake manifold 29**, more precise control of the recirculated blow-by gas amount may be achieved in accordance with engine operating conditions and accordingly with the blow-by discharge amount.

As will be appreciated from the above, according to the first embodiment gas flow rate control system, the flow rate of the gas to be supplied through the gas flow passage to engine combustion chamber can be controlled at appropriate values corresponding to engine operating conditions, preventing excessive amounts of fresh air from entering the crankcase. This makes possible to carry out precise air-fuel ratio control in accordance with engine operating conditions. Further, since the operation of the gas flow rate control system is effected by air suction of the internal combustion engine, no vacuum source is necessary and therefore the system is made small-sized. Furthermore, whole the amount of blow-by gas in the crankcase is absorbed in the stream of air flowing through the gas flow passage even during a high speed and low load engine operating condition where a relatively large amount of blow-by gas is discharged into the crankcase, thereby preventing blow-by gas from emitting to the atmosphere and from entering an air cleaner or a carburetor thereby to protect them from contamination. Moreover, the control valve 20 and the bypass passage 24 of the gas flow rate control system are formed vertically, and therefore large amounts of water contained in the blow-by gas and adhered to the inside wall surface of control valve 20 and the bypass passage 24 in the form of droplets can be readily removed from the gas flow rate control system.

Figure 3:
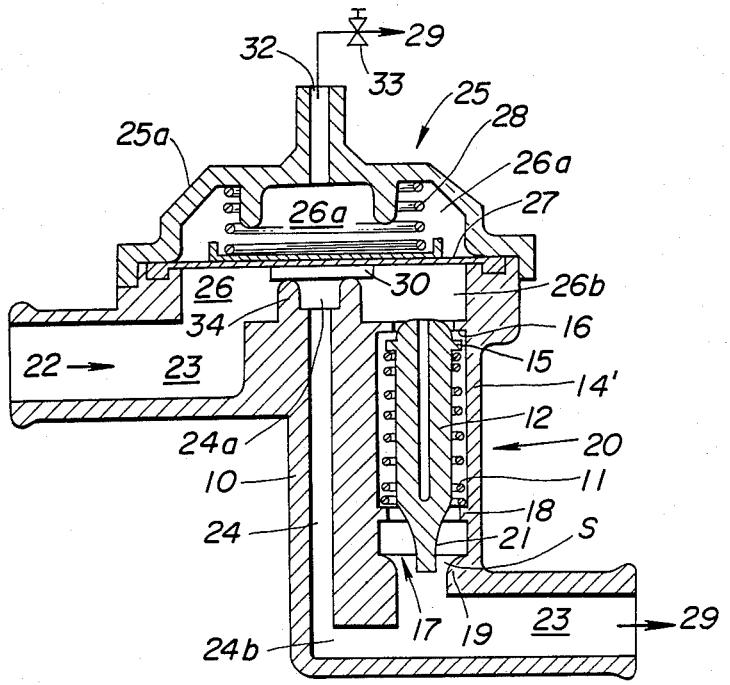
FIG. 3 is a vertical cross-sectional view similar to FIG. 2 but showing a second embodiment of the gas flow rate control system according to the present invention.

FIG. 3 illustrates a second embodiment of the gas flow control system in accordance with the present invention, which is similar to the first embodiment of FIG. 2 with the exception that the bypass passage 24 is formed separate from the control valve 20 for the purpose of independently deciding the gas flow rate of the bypass passage 24 from the control valve 20. In this embodiment, the gas chamber **26*b* of the diaphragm actuator 25 serves as a part of the gas flow passage 26 connecting the crankcase 22 and the intake manifold 29. In other words, the gas flow passage 26 upstream of the control valve 20 connects with the gas chamber 26*b* which is in turn communicable with the valve housing inside space between the valve seat 16 and spring seat 18 through the clearance to be formed between the end section of the valve member 12 and the valve seat 16. In this embodiment, the valve member 12 is located upside down relative to that in the first embodiment of FIG. 2, in which the gas supplied to the gas chamber 26*b* flows downwardly through the control valve 20 to be sucked into the intake manifold 29. The bypass passage 24 extends parallel with the axis of the control valve 20 and is so arranged that its inlet portion 24*a* directly connects with the inside space of the cylindrical valve seat 34 of the diaphragm actuator 25 whereas its outlet portion 24*b* directly connects with the gas flow passage 23 downstream of the flow rate control section 17 of the control valve 20. In this embodiment, the control valve 20 does not include a separate valve housing, and therefore a generally cylindrical section 14' corresponding to the valve housing formed integral with the casing 10, so that the valve seat 16 and the spring seat 18 are formed integral with the casing cylindrical section 14'**.

With this configuration, when the diaphragm member 27 is so positioned that the valve member 30 is seated on the valve seat 34 under the engine operating conditions where the intake manifold vacuum supplied to the diaphragm actuator vacuum chamber **26*a* is lower or weaker than the predetermined level, the gas containing blow-by gas from the crankcase 22 flows into the diaphragm actuator gas chamber 26*b* and then flows through the control valve 20 so as to be controlled in its flow rate in accordance with intake manifold vacuum prevailing in the intake manifold 29. On the other hand, when the diaphragm member 27 moves upwardly in the drawing so that the valve member 34 separates from the valve seat 34 to allow the bypass passage inlet portion 24*a* to communicate with the gas chamber 26*b*, the gas supplied to the gas chamber 26*b* flows both through the control valve 20 and the bypass passage 24 and is supplied to the gas flow passage 23 downstream of the flow rate control section 17 of the control valve 20. Thus, control of gas flow through the bypass passage 24 is made only in response to the movement of the diaphragm member 27 regardless of operation of the control valve 20**.

Figure 4:
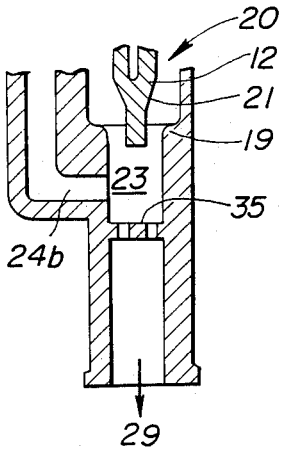
FIG. 4 is a fragmentary cross-sectional view of an essential part of a third embodiment of the gas flow rate control system according to the present invention similar to the second embodiment.

FIG. 4 illustrates a third embodiment of the gas flow rate control system according to the present invention, which is similar to the second embodiment of FIG. 3 except for the configuration of the gas flow passage 23 downstream of the control valve 20. In this embodiment, the gas flow passage 23 downstream of the control valve 20 is formed straight and axially aligned with the control valve 20. Additionally, a stopper 35 is formed inside the gas flow passage 23 slightly downstream of a section to which the bypass passage outlet portion **24*b* opens, in such a manner that the tip of the valve member straight portion 12*a* can strike against the stopper 35. This restricts the lower moving limit of the valve member tapered portion 21 relative to the annular porojection 19 constituting the flow rate control section 17 thereby to set the minimum flow rate of the gas flowing through the gas flow passage 23. In this embodiment, the stopper 35 is of the shape of a disc formed with a plurality of through-holes, and formed integral with the wall surface of the gas flow passage 23**.

Figure 5:
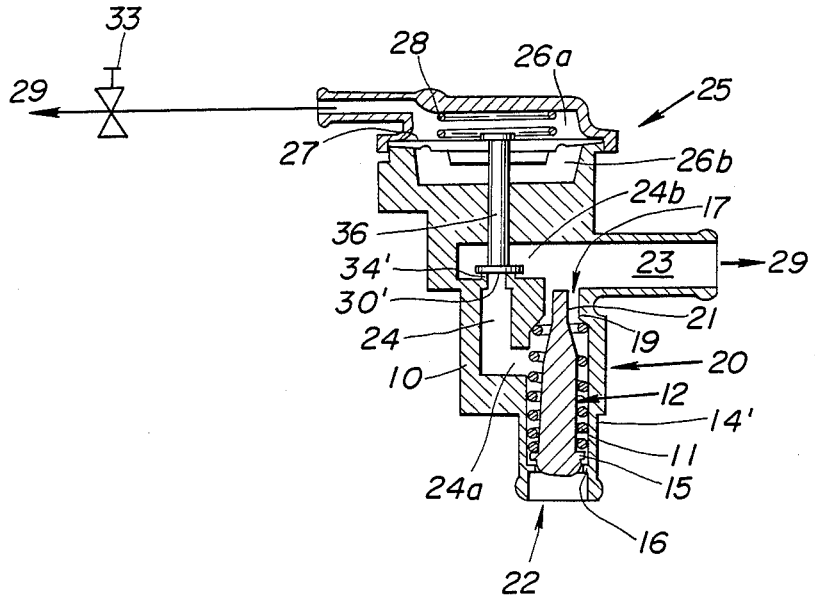
FIG. 5 is a vertical cross-sectional view similar to FIG. 2 but showing a fourth embodiment of the gas flow rate control system according to the present invention.

FIG. 5 illustrates a fourth embodiment of the gas flow rate control system according to the present invention, which is similar to the first embodiment of FIG. 2 fundamentally with exception that the bypass passage 24 is formed independent from the gas chamber **26*b* of the diaphragm actuator 25. In this embodiment, a valve stem or plunger 36 is secured at its upper end to the diaphragm member 27 and extends as viewed in the drawing. A valve member or head 30' is provided at the lower end of the valve stem 36 to be able to be seated on an annular valve seat 34' inside which the bypass passage 24 is formed, so that the bypass passage 24** is closed upon contact of the valve member 34' with the valve seat 34'. In other words, the bypass passage 24 extends through the inside of the valve seat 34' and connects two portions of the gas flow passage upstream and downstream of the flow rate control section 17. In this embodiment, the control valve 20 does not include a separate valve housing, and therefore a generally cylindrical section 14' corresponding to the valve housing is formed integral with the casing 10, so that the valve seat 16 and the spring seat 18 are formed integral with the casing cylindrical section 14'. The casing cylindrical section 14' is formed with a vertically extending cylindrical opening in which the valve member 12 and the spring 11 are disposed. As shown, the inlet portion 24*a* of the bypass passage 24 connects or opens to the inside opening of the casing cylindrical section 14' whereas the outlet portion 24*b* of the same connects or opens to the gas flow passage downstream of the flow rate control section 17.

With this configuration, when the intake manifold vacuum supplied to the diaphragm actuator vacuum chamber 26*a* exceeds the predetermined level, the diaphragm member 27 causes the valve member 30' to separate from the valve seat 34' thereby to allow gas flow through the bypass passage 24. Accordingly, the gas containing blow-by gas supplied to the inside space of the control valve 20 bypasses the flow rate control section 17 to be supplied to the gas flow passage 23 downstream of the flow rate control section 17, so that a relatively large amount of blow-by gas is fed to engine combustion chamber even though the flow rate of the gas flowing through the flow rate control section 17 is minimized.

Figure 6:
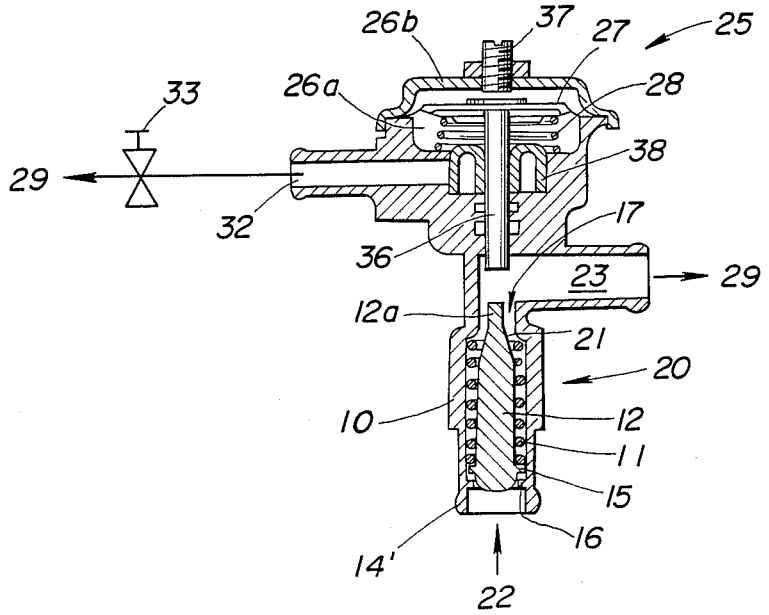
FIG. 6 is a vertical cross-sectional view similar to FIG. 2 but showing a fifth embodiment of the gas flow rate control system according to the present invention.

FIG. 6 illustrates fifth embodiment of the gas flow control system according to the present invention, which is similar to the fourth embodiment of FIG. 5 with the exception that no bypass passage (24) is provided and consequently no valve member (34') is provided. In this embodiment, the lower end section 36*a* of the plunger 36 projects into the gas flow passage 23 downstream of the flow control section 17, and adapted to be contactable with the tip end of the straight portion 12*a* of the valve member 12. Accordingly, the plunger 36 can controllably restrict the vertical location of the valve member 12. Additionally, an adjustment screw 37 is provided to adjust the upper movement limit of the diaphragm member 27 and accordingly the plunger 36. An annular sealing member 38 is disposed around the plunger 36 to maintain gas-tight seal between the plunger 36 and the casing 10 defining the vacuum chamber 26*a* of the diaphragm actuator 25. Thus, with this configuration, the gas flow control action of the control valve 20 can be regulated in response to variation of the intake manifold vacuum supplied to the diaphragm actuator 25.

Figure 7:
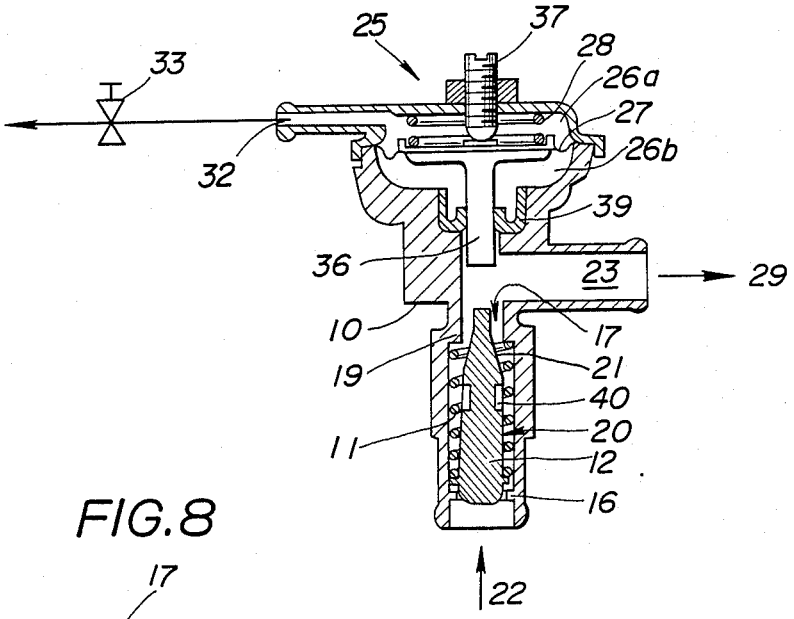
FIG. 7 is a vertical cross-sectional view similar to FIG. 2 but showing a sixth embodiment of the gas flow rate control system according to the present invention.

FIG. 7 illustrates a sixth embodiment of the gas flow control system according to the present invention, which is similar to the fifth embodiment with the exception that the diaphragm actuator 25 is so adapted that the plunger is normally biased downwardly under the bias of the spring 28 thereby to push down the valve member 12 in a direction that the lower end section of the valve member 12 contacts with the valve seat 16 to obtain a closed state of the control valve 20. Additionally, this embodiment is so arranged that when the intake manifold vacuum supplied to the diaphragm actuator vacuum chamber 26*a* exceeds or becomes stronger than the predetermined level, the diaphragm member 27 moves upwardly to contact with the adjustment screw 37 thereby to allow the valve member 12 to be positioned in its upper limit position. In this embodiment, an annular sealing member 39 is provided between the plunger 36 and the casing 10 to maintain gas-tight seal of the gas flow passage 23. Additionally, the valve member 12 is formed at its outer peripheral surface with an annular groove 40 which is so located as to move to the vicinity of the annular projection 19 constituting the flow control section 17 thereby to increase the space S between the surface of the valve member 12 and the annular projection 19. Thus, the flow rate of the gas flowing through the gas flow passage 23 is increased when the intake manifold vacuum is increased over the predetermined level.

Figure 8:
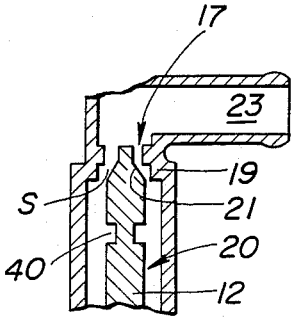
FIG. 8 is a fragmentary cross-sectional view of an essential part of a seventh embodiment of the gas flow rate control system according to the present invention similar to the sixth embodiment.
Figure 9:
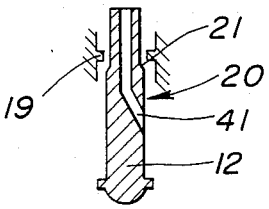
FIG. 9 is a fragmentary cross-sectional view similar to FIG. 8 but showing an eighth embodiment of the gas flow rate control system according to the present invention.
Figure 10:
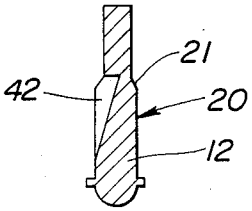
FIG. 10 is a fragmentary cross-sectional view similar to FIG. 8 but showing a ninth embodiment of the gas flow rate control system according to the present invention.

FIGS. 8, 9 and 10 illustrate seventh, eighth and ninth embodiments of the gas flow control system according to the present invention, which are substantially the same as the sixth embodiment of FIG. 7 and accordingly only essential parts are shown and described.

In the seventh embodiment of FIG. 8, the annular projection 19 forming part of the flow rate control section 17 is formed step-like to maintain a larger space S between the annular projection 19 and the surface of the valve member tapered portion 21 when the annular groove 40 approaches the annular projection 19.

In the eighth embodiment of FIG. 9, the valve member 12 is formed with an axially elongate through-opening 41 in place of the annular groove 40 in the sixth embodiment of FIG. 7. The through-opening 41 has an upper end opened through the upper end of the valve member to which the plunger 36 is contactable to close the through-hole 41. The lower end of the through-hole 41 is opened through the side wall of the valve member 12. The through-opening 41 is so located that the upstream and downstream sides of the annular projection 19 forming part of the flow rate control section 17 communicate with each other through the through-opening 41 when the valve member 12 is in its upper limit position.

In the ninth embodiment of FIG. 10, the valve member 12 is formed with a slot 42 extending to the tapered portion 21. The slot 42 is so located as to be positioned near the annular projection 19 constituting a part of the flow rate control section 17 when the valve member 12 is in its upper limit position.

Figure 11:
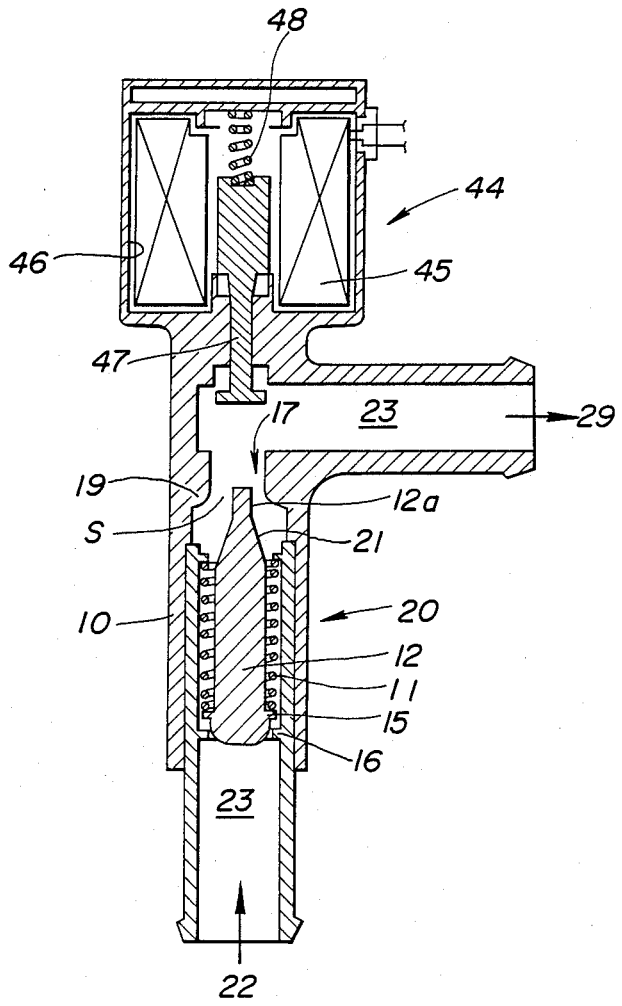
FIG. 11 is a vertical cross-sectional view similar to FIG. 2 but showing a tenth embodiment of the gas flow rate control system according to the present invention.

FIG. 11 illustrates a tenth embodiment of the gas flow control system according to the present invention, which is similar to the fifth embodiment of FIG. 6 with the exception that the vertical movable location of the valve member 12 can be controlled by a solenoid 45 of a solenoid actuator 44 used in place of the diaphragm actuator 25 of the fifth embodiment. In this embodiment, the solenoid 45 is securely positioned within a control chamber 46 formed at the top section of the casing 10. The solenoid 45 is adapted to move a plunger 47 extending downwardly passing through the wall of the casing 10 to be contactable with the valve member 12. The solenoid actuator 44 is of a so-called push-type so that the plunger 47 is forced downward against the bias of a tension spring 48 so as to push down the valve member 12 when the solenoid 45 is actuated upon receiving electric signal, thus controlling the flow rate of the gas passing through the control valve 20. The solenoid actuator 44 may be of a so-called pull-type wherein the plunger 47 is driven downwardly in the drawing. The plunger 47 is axially aligned with the valve member 12 so that the lower end of the plunger 47 is completely contactable with the tip end of the straight portion 12a of the valve member 12. The electric signal supplied to the solenoid 45 is electric pulse having a certain frequency, so that the plunger 25 receives electromagnetic force corresponding to ON-time of the electric pulse which is impressed to the solenoid 45. Thus, the plunger 47 moves in response to the electric pulse provided to the solenoid 45, thereby controlling the axial location of the valve member 12.

Figure 12:
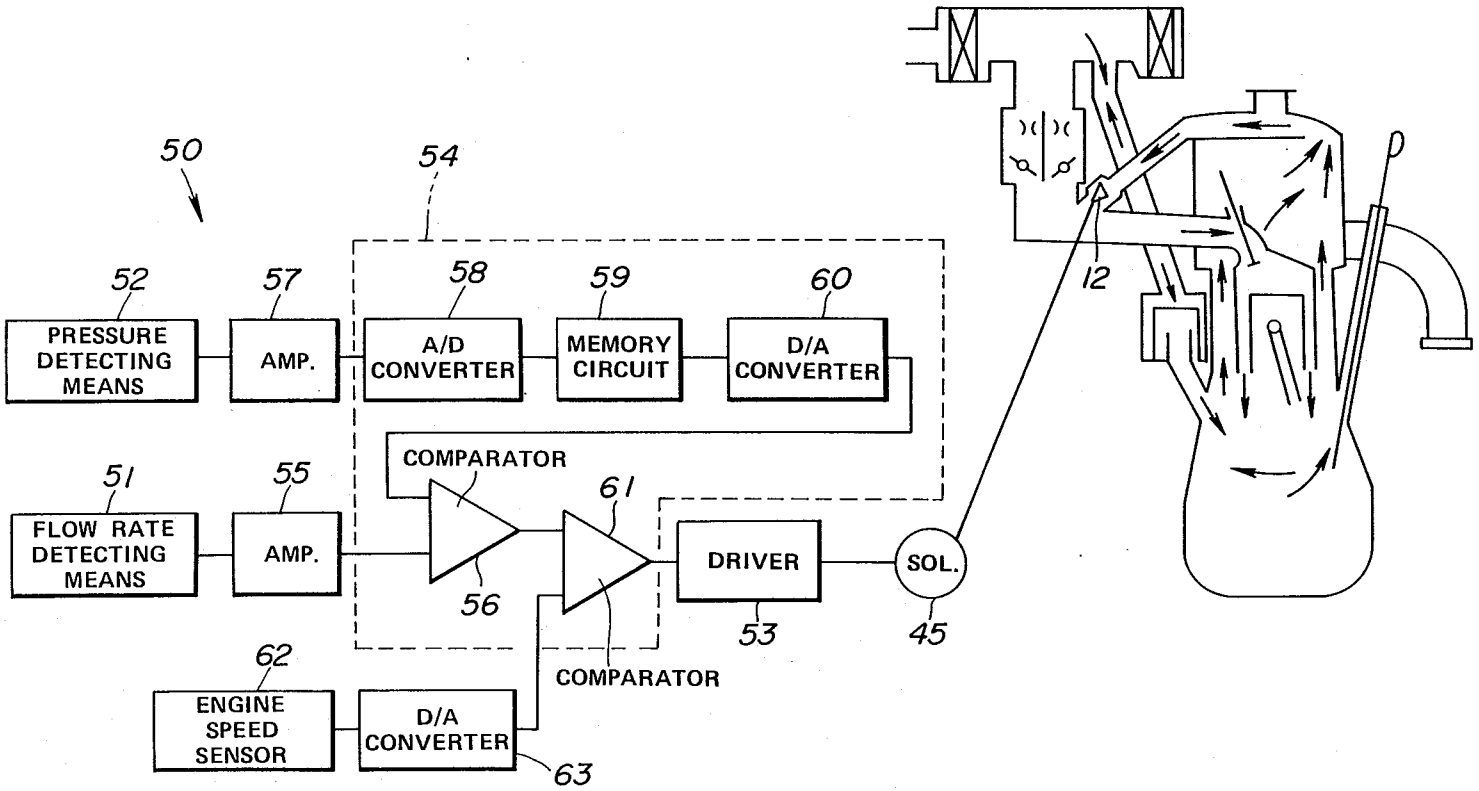
FIG. 12 is a schematic illustration of the gas flow rate control system of FIG. 11, showing a control circuit for a solenoid used in the control system.

The electric pulse provided to the solenoid 45 is controlled by a control circuit 50 as shown in FIG. 12. The control circuit 50 includes flow rate detecting means 51 for detecting gas flow rate of the gas flow passage 23, pressure detecting means 52 for detecting pressure or vacuum prevailing in the intake manifold, and a comparing circuit 54 adapted to compare signals from the flow rate detecting means 51 and the pressure detecting means 52 and an output signal corresponding to the difference therebetween to a driver 53 electrically connected to the solenoid 45.

More specifically, a pressure sensor is used as the flow rate detecting means 51 because the cross-sectional area of the gas flow passage 23 is constant. A known piezoelectric-crystal element or piezoelectric transducer is used as the pressure sensor and as the pressure detecting means 52. The flow rate detecting means 51 is electrically connected through an amplifier 55 to a comparator 56. The pressure detecting means 52 is electrically connected through an amplifier 57 to a A/D converter 58. The A/D converter 58 is electrically connected to a memory circuit constituted by a ROM (ready-only memory) so that output of the converter 58 is provided to the memory circuit 59. This memory circuit 59 stores therein the data representing the amount (λ/min) of blow-by gas discharged from the engine combustion chamber into the crankcase in terms of intake manifold vacuum. Accordingly, the memory circuit 59 is adapted to produce output corresponding to signal (representative of pressure or vacuum) from the pressure detecting means 52 and output it to A/D converter 60 which is electrically connected to the memory circuit 59. The output of the D/A converter 60 is supplied to a comparator 56 electrically connected to the D/A converter 60. In this comparator 56, the signal corresponding to the outputs of the flow rate detecting means 51 and the pressure detecting means 52 are compared thereby to an output signal corresponding to the difference therebetween and a comparator 61 which is electrically connected to the comparator 56 and connected through a D/A converter 63 to an engine speed sensor 62. Accordingly, signal corresponding to engine speed is impressed through the D/A converter 63 to the comparator 61 to make correction of the signal from the comparator 56 in accordance with the characteristics of engine speed. The output of the comparator 61 is fed to a driver 53 electrically connected to the comparator 61. The driver 53 is electrically connected to the solenoid 45, so that the output of the comparator 61 is supplied through the driver 53 to the solenoid 45, for example, to control of the location of the valve member 12 of the control valve 20 in such a manner that the difference between the signals from the flow rate detecting means 51 and the pressure detecting means 52 becomes zero. Thus, for example, the control valve 20 can be so controlled as to make equal the flow rate of the gas flowing through the gas flow passage 23 and the amount of blow-by gas discharged from the engine combustion chambers into the crankcase.

Figure 13:
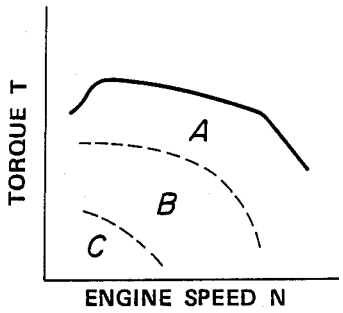
FIGS. 13 and 14 are graphs showing examples of relationships of engine operating parameters, with reference to which the control characteristics of the gas flow rate control system of FIGS. 11 and 12 is decided.
Figure 14:
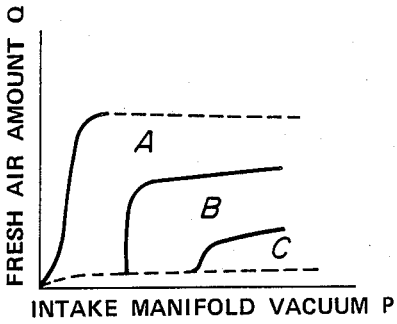

In order to design the gas flow rate control system shown in FIGS. 11 and 12, the characteristics of respective parts is decided with reference to the graph of FIG. 13 representing the relationship between engine speed N and engine torque Q and to the graph of FIG. 14 representing the relationship between intake manifold pressure P and the amount Q of fresh air to be supplied to the engine crankcase. The same characters A, B and C between FIGS. 13 and 14 indicate the corresponding relationship.

Although only the solenoid 26 has been shown and described as means for driving the plunger 47 in the tenth embodiment, it will be understood that an electric servomotor such as a stepping motor or a motor provided with a rotary encoder may be used in place of the solenoid 26, in which the valve member 12 can be very accurately controlled at a desirable location upon measuring a pulse of the stepping motor or signal of the rotary encoder.

Figure 15:
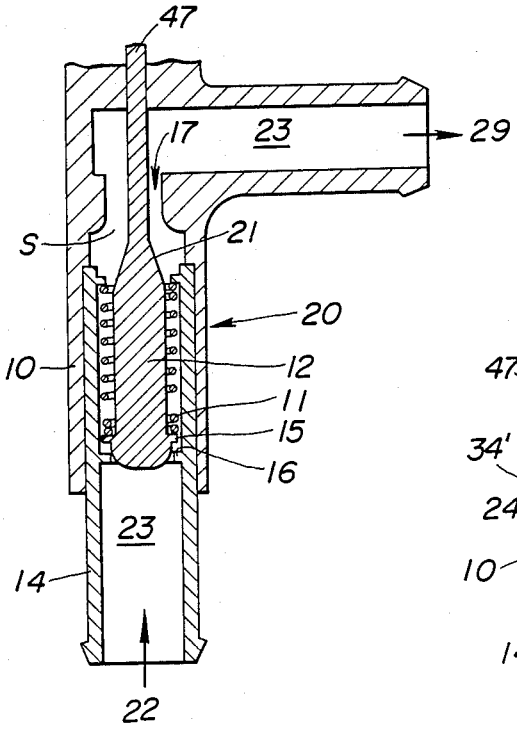
FIG. 15 is a fragmentary cross-sectional view of an essential part of an eleventh embodiment of the gas flow rate control system according to the present invention similar to the tenth embodiment.

FIG. 15 illustrates an eleventh embodiment of the gas flow control system according to the present invention, similar to the tenth embodiment of FIGS. 11 and 12 with the exception that the plunger 47 is integrally connected with the valve member 12. In this embodiment, one of the springs 11, 48 may be omitted. Additionally, the solenoid actuator 44 may be of a so-called push-and-pull type wherein the plunger 47 is driven in vertically opposite directions so that the valve member 12 is controlled both in open and closed directions.

Figure 16:
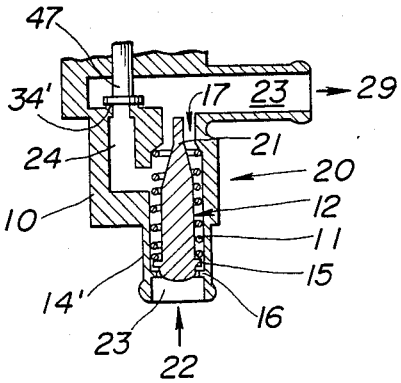
FIG. 16 is a fragmentary cross-sectional view similar to FIG. 15 but showing a twelfth embodiment of the gas flow rate control system according to the present invention.

FIG. 16 illustrates a twelfth embodiment of the gas flow control system according to the present invention, similar to the tenth embodiment. In this embodiment, the bypass passage 24 is formed to connect the upstream side and the downstream side of the flow rate control section 17 like in the fourth embodiment of FIG. 5. The bypass passage 24 is formed passing through the valve seat 34' to which the plunger 47 of the solenoid 26 is contactable to control gas flow through the bypass passage 24.

Although the control circuit 50 has been shown and described as controlling the solenoid 45, it will be understood that the control circuit 50 may be used to control the vacuum control valve 33 shown in the first to ninth embodiments.

While the gas flow rate control system according to the present invention has been shown and described only as being used for blow-by gas recirculation systems including a flow control valve such as a PCV valve, the gas flow rate control system is applicable to a so-called exhaust gas recirculation (EGR) system including an EGR valve in which a part of exhaust gas is controllably recirculated back to the engine combustion chamber through the EGR valve.

What is claimed is:

1. A gas flow rate control system for an internal combustion engine having an intake air passage through which intake air forming an air-fuel mixture to be inducted into an engine combustion chamber flows, said gas flow rate control system comprising:

means defining a gas flow passage through which amounts of gas discharged from the combustion chamber flow back to the combustion chamber, said gas flow passage being independent from the intake air passage;

a control valve disposed in said gas flow passage to control flow rate of the gas flowing in said gas flow passage in accordance with control characteristics, said control valve including a valve member which is disposed within said gas flow passage and along an axis of the gas flow passage movable in accordance with intake vacuum developed in the engine and introduced into said gas flow passage, said gas flow rate being determined in accordance with axial movement of said valve member; and means for compensating the control characteristics of said control valve in accordance with an engine operating parameter, said control characteristics compensating means including means for changing said gas flow rate in accordance with said engine operating parameter wherein said means for compensating includes means defining a bypass passage connecting first and second portions of said gas flow passage, said first and second portions being located on upstream and downstream sides of a control valve flow rate control section, respectively, and compensation valve means for controlling flow of the gas passing through said bypass passage in accordance with said engine operating parameter.

2. A gas flow rate control system as claimed in claim 1, wherein said engine operating parameter is related to the amount of the gas discharged from the combustion chamber.

3. A gas flow rate control system as claimed in claim 1, wherein said gas contains blow-by gas, wherein said gas flow passage fluidly connects an associated crankcase of the engine and said intake air passage to recirculate the blow-by gas back to the engine combustion chamber.

4. A gas flow rate control system as claimed in claim 1, wherein the control characteristics of said control valve is decided in accordance with intake vacuum developed in the engine.

5. A gas flow rate control system as claimed in claim 3, wherein said gas flow passage fluidly connects the engine crankcase and an intake manifold of the engine.

6. A gas flow rate control system as claimed in claim 4, wherein said control valve includes said flow rate control section through which flow rate of the gas is controlled, said flow rate control section forming part of said gas flow passage.

7. A gas flow rate control system as claimed in claim 1, wherein said means for compensating includes a valve member by which said bypass passage is closable, and an actuator for actuating said valve member in accordance with intake vacuum developed in the engine.

8. A gas flow rate control system as claimed in claim 7, wherein said actuator includes a diaphragm member defining a vacuum chamber to be filled with the intake vacuum, said valve member being secured to said diaphragm member.

9. A gas flow rate control system as claimed in claim 8, wherein said intake vacuum is intake manifold vacuum.

10. A gas flow rate control system as claimed in claim 8, wherein said actuator includes a spring for biasing said diaphragm member in a direction to allow said valve member to close said bypass passage.

11. A gas flow rate control system as claimed in claim 6, wherein said means for compensating includes vacuum control valve means for controlling the intake vacuum to be supplied to said actuator vacuum chamber, in accordance with at least one engine operating parameter.

12. A gas flow rate control system as claimed in claim 6, wherein said control valve includes means defining an annular projection formed on an inner wall defining said gas flow passage, a valve member axially movably disposed in said gas flow passage and formed in its one end with a tapered portion which is coaxial and movable relative to said annular projection to define therebetween a variable space serving as said flow control section, biasing means for biasing said valve member in a direction to cause said tapered portion to separate from said annular projection, and means by which said tapered portion is moved in a direction toward said annular projection against bias of said biasing means upon intake vacuum acting on said valve member.

13. A gas flow rate control system for an internal combustion engine having an intake air passage through which intake air forming an air-fuel mixture to be inducted into an engine combustion chamber flows, said gas flow rate control system comprising:

means defining a gas flow passage through which amounts of gas discharged from the engine combustion chamber flow back to the engine combustion chamber, said gas flow passage being independent from the intake air passage;

a control valve disposed in said gas flow passage to control flow rate of the gas flowing in said gas flow passage in accordance with control characteristics, said control valve including a valve member which is disposed within said gas flow passage and along an axis of the gas flow passage movable in accordance with intake vacuum developed in the engine and introduced into said gas flow passage, said gas flow rate being decided in accordance with axial movement of said valve member, a part of said valve member defining a flow rate control section through which said gas flow rate is controllable, said flow rate control section forming part of said gas flow passage; and means for compensating the control characteristics of said control valve in accordance with an engine operating parameter, said compensating means including means defining a bypass passage connecting first and second portions of said gas flow passage, said first and second portions being located on upstream and downstream sides of said control valve flow rate control section, respectively, and compensation valve means for controlling flow of the gas passing through said bypass passage in accordance with said engine operating parameter.

14. A gas flow rate control system for an internal combustion engine having an intake air passage through which intake air forming an air-fuel mixture to be inducted into an engine combustion chamber flows, said gas flow rate control system comprising:

means defining a gas flow passage through which amounts of gas discharged from the combustion chamber flow back to the combustion chamber, said gas flow passage being independent from the intake air passage;

a control valve disposed in said gas flow passage to control flow rate of the gas flowing in said gas flow passage in accordance with control characteristics, said control valve including a valve member which is disposed within said gas flow passage and along an axis of the gas flow passage movable in accordance with intake vacuum developed in the engine and introduced into said gas flow passage, said gas flow rate being decided in accordance with axial movement of said valve member; and means for compensating the control characteristics of said control valve in accordance with an engine operating parameter, said control characteristics compensating means including a movable plunger to control the axial movement of said valve member, and an actuator for controlling the movement of said plunger in accordance with said engine operating parameter.

* * * * *